United States Patent [19]

von Blücher et al.

[11] 4,454,191

[45] Jun. 12, 1984

[54] WATERPROOF AND MOISTURE-CONDUCTING FABRIC COATED WITH HYDROPHILIC POLYMER

[76] Inventors: Hubert von Blücher, Freytagstrasse 45; Hasso von Blücher, Sohnstrasse 58, both of D-4000 Düsseldorf; Ernest de Ruiter, Höhenstrasse 57a, D-5090 Leverkusen 3, all of Fed. Rep. of Germany

[21] Appl. No.: 408,986

[22] Filed: Aug. 17, 1982

[30] Foreign Application Priority Data

Aug. 17, 1981 [DE] Fed. Rep. of Germany ..... 3132324

[51] Int. Cl.[3] ..... A61L 15/00

[52] U.S. Cl. ..... 428/244; 428/248; 428/249; 428/251; 428/252; 428/262; 428/264; 428/265; 428/267; 428/268; 428/286; 428/287; 428/290; 428/311.1; 428/311.5; 428/311.7; 428/311.9; 428/314.2; 428/913

[58] Field of Search ..... 428/244, 248, 249, 251, 428/252, 262, 264, 265, 267, 268, 286, 287, 290, 311.1, 311.5, 311.7, 311.9, 314.2, 913

[56] References Cited

U.S. PATENT DOCUMENTS

| | | | |
|---|---|---|---|
| 3,692,623 | 9/1972 | Kimura | 428/314.2 |
| 3,713,868 | 1/1973 | Gordon | 428/314.2 |
| 4,061,822 | 12/1977 | Brodnyan | 428/314.2 |
| 4,146,027 | 3/1979 | Hoey | 428/314.2 |

*Primary Examiner*—Marion McCamish

*Attorney, Agent, or Firm*—Sprung, Horn, Kramer & Woods

[57] ABSTRACT

A waterproof and moisture-conducting fabric comprising a base permeable to water vapor and sealed with a closed coating of a hydrophilic polymer. The sealing coating is advantageously a compressed foam of an acrylic resin modified with polyvinyl chloride or polyurethane. A second base may be laminated onto the sealing layer. Protective fillers such as lead compounds and carbon may be included in or on the coating. The fabric is suited for protective clothing articles such as rescue-at-sea garments and shoe uppers, and sleeping bags.

14 Claims, 5 Drawing Figures

WATERPROOF AND MOISTURE-CONDUCTING FABRIC COATED WITH HYDROPHILIC POLYMER

Figure 1:
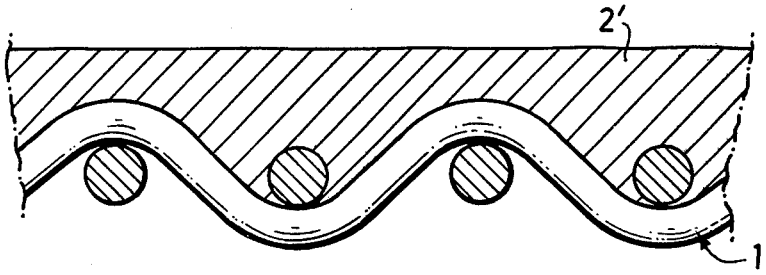

The invention is a waterproof and moisture-conducting fabric.

The most effective way of getting rid of excess human-body heat is the evaporation of water. This normally occurs in the skin, which keeps it dry. This mechanism, however, can function only when the resulting water vapor can be eliminated. Clothing can be comfortable, therefore, only when it allows water vapor to permeate through it from the skin. Usually this is accompanied by a more or less high level of air permeability. This has led to the basically erroneous concept that the skin "breathes." Actually the skin does not breath, but only releases moisture.

There are conditions in which it is demanded that a fabric not only allow water vapor to permeate but also be satisfactorily waterproof and airtight. Such fabrics are employed for protective garments like antiweather, occupational, and military safety clothing and for recreational clothing and equipment like parkas, tents, and sleeping bags.

Attempts have been made to remove water vapor from the skin by introducing hydrophilic bodies, based on starch for example, that swell up with water into coatings that do not permit water vapor to permeate. The most significant result however was to diminish the mechanical properties of the coating. It has also been attempted to laminate fabrics to a microporous film, of polytetrafluorethylene for example. Such products, however, also have drawbacks as well as being complicated and extremely expensive to manufacture.

The present invention is intended as a fabric that is not only waterproof and airtight but that also stores a significant amount of moisture, conducts it, and releases it from both sides in the form of water vapor.

It is desirable for a fabric to store moisture in this manner because, since the body does not perspire at a rate that is constant over time, clothing must be able to deal like a "buffer" with a temporary surplus production of moisture that can not be rapidly enough expelled. It is also important to combine this buffer effect, which contributes so much to comfort, with moisture transport in a way that will not adversely affect the mechanical properties of the fabric. It should also be possible, for special purposes, to accompany all these properties with the specific ability to protect the wearer against aggressive chemicals, bacteria, or radiation, etc.

The invention achieves these objectives because it is a waterproof and moisture-conducting fabric consisting of a base that allows water vapor to permeate and that is sealed with a closed layer of a hydrophilic polymer.

The sealing layer is in particular a layer of foam that can subsequently be compressed. The application and subsequent compression of layers of foam are conventional in the fabric industry. Another possibility is the application of a coating of foam followed by the application of another layer and of a layer of paste, solution, dispersion, or melt.

The base of the fabric may be a woven or knit or even a felt or nonwoven fabric. It may be composed of natural fibers like cotton, wool, or silk, of synthetic fibers based on polyesters, polyamides, polyacrylonitrile, polyurethanes, polyolefins, polyvinyl chloride, or aramides, or even of mineral fibers like glass or carbon fibers. Whether the base itself is hydrophobic or hydrophilic is not decisive. It must, however, be permeable to water vapor. The hydrophilicity of the fibers themselves may also contribute to permeability when the fabric is very dense and only slightly permeable to air, whereas a hydrophobic base should be open enough to permit enough water vapor to permeate.

A base that is permeable to water vapor can be sealed as desired by the application of a closed layer of hydrophilic polymer. Appropriate hydrophilic polyers are known or can be prepared or compounded by fabric chemists from conventional components. The properties of absorbing water vapor at points of high partial pressure, effecting its migration within the layer in the form of water molecules to points of low partial pressure, and releasing it in the form of water vapor again at the surface of the fabric can be obtained by introducing enough hydrophilic groups, especially hydroxyl-ether-amine or carboxyl groups. These hydrophilic groups can be produced, on the bases of the copolymerization or cocondensation of monomers that effect chain formation or cross-linkage, with hydrophilic monomers. It is also possible to prepare polymerization with very high water-absorption capabilities together with polymers that, although they contribute other desirable properties, are themselves not, or only slightly, hydrophilic.

Hydroxyalkylacrylates and the acrylic or methacrylic esters of polyalkylene oxides or polyalkylenimides are examples of monomers with hydrophilic groups. Acrylic- or methacrylic-acid derivatives of this type can subsequently be copolymerized with the acrylic or methacrylic ester that forms the basic polymerizate and with cross-linking monomers. Dispersions of hydrophilic resins of this type are known, from German OS No. 2 749 386 for example. The commercially available Plextrol 4871D, manufactured by the firm of Röhm, as well as modified vinyl-alcohol resins or regenerated cellulose are also practical for a moisture-conducting sealing layer. Copolymerizates of vinyl chloride and vinyl acetate in which the acetate groups have been hydrolyzed into OH groups or polyurethanes with excess OH or NH and $NH_2$ groups are also appropriate. It is also possible, in the same way that the hydrophilic monomers themselves are copolymerized, to blend dispersions obtained from them with dispersions that have properties that are desirable for other reasons. Polyurethanes, for example, have very satisfactory mechanical properties, while polyvinyl chloride improves flame resistance. A polyvinyl chloride with built-in monomers that have powerfully hydrophilic groups can also be employed. The desired properties can also be introduced into polyurethanes by using starting materials that have enough hydrophilic groups, especially ether or imine groups.

It is easy to test a coating to determine whether its moisture absorption and conduction are as satisfactory as those claimed for the invention. Layers in accordance with the invention will in practical terms store 200 to 400% of their weight in moisture and allow at least 500 $g/m^2/24$ hours of water vapor to permeate through them in accordance with DIN 53 122.

As long as these results are confirmed, the coating may also contain such conventional additives as dyes, adhesion enhancers, antioxidants, antistatics, pigments, thermal stability agents, fillers, etc.

The coating is usually applied in the form of 5–500 $g/m^2$ in terms of the dry weight of a dispersion or foam (which can subsequently be compressed). When it is necessary for the coating to be airtight as well and a thick fabric, especially a woven fabric, that is only slightly air-permeable is accordingly employed as a base, a dry layer weighing more than 50 g/m$^2$ is recommended. For many purposes, especially in conjunction with a base that is not very thick or air-permeable, a very light coating of a hydrophilic polymer that is still air-permeable is very practical. Such thin coatings can be obtained by abrading away a dry layer of 5–50, and especially 10–30, g/cm$^2$. Such a waterproof but still more or less air-permeable and in any event moisture-conducting fabric has for example been demonstrated to be very satisfactory for permeable, meaning active-breathing, ABC-protection suits, which usually contain an outer coating and, underneath it, a filter layer that absorbs gaseous but not liquid chemical-warfare agents. One function of the outer coating is accordingly to keep liquid agents away from the filter layer. Oleophobic finishes are used for this purpose. Drops of a chemical agent, like those deriving from an aerosol or spray for example, that fall from greater heights may have enough kinetic energy to penetrate the outer coating and soak the filter layer. This will result in penetration of the locally overstressed filter layer. It has however been demonstrated that even the thin layer of hydrophilic polymers in question, which, although it slightly decreases the air-permeability of the fabric, does allow water vapor to permeate, will impede the penetration of the drops of chemical agent without significantly affecting the wearing properties of the protective clothing.

The vapor-permeable coating is also practical as a binder for laminating fabrics when another layer of vapor-permeable textile is applied to the coating of hydrophilic polymers. This results in a double-layered material, the outside of which can if desired be additionally hydrophobed.

A sealing layer of hydrophilic polymer can be applied not only to one side but also to both sides of the base of the invention.

Substances with specific protective properties—lead sulfate against radiation, activated carbon against chemical-warfare agents, and antimony(III) oxide or halogenated aromatic compounds for flame resistance, for example—can be introduced into the coating. These or other substances with specific protective properties can also be applied to the coating, which will simultaneously function as a binder for them:

A porous hydrophobing of the outer surface of the material that will not affect vapor permeability is also recommended for later use with respect to the base itself, to a laminated material, or to the sealing layer.

Whereas the water-repellent action of hydrophobing does not last very long because from a microscopic standpoint it is applied in points or clusters, the water uptake of the sealing layer in the invention makes the layer swell up, augmenting its sealing action. This is a particular advantage when impermeability is essential, in rescue-at-sea suits for aviators for instance, which must be comfortable when worn under normal circumstances but waterproof in emergencies to protect aviators from the incursion of water and hence hypothermia for a certain length of time when they have to parachute over frigid seas. This is one of the applications for which the waterproof, moisture-conducting fabric in accordance with the invention is especially appropriate. Other examples are protective clothing for various fields like ABC warfare, civil defence, and atomic power plants. The vapor-permeable coating can block the penetration of water, dust, and gas.

The polyurethane, when emloyed, may be applied as a dispersion or other liquid form, e.g. a melt of 100% binder.

The vapor-permeable double-layer materials in accordance with the invention and described above are appropriate for high-quality and comfortable rainwear, sleeping bags, sportswear, shoe uppers, etc.

The invention will be further described with reference to the drawing, wherein:

FIGS. 1 to 5 are vertical sections through five different coated fabrics in accordance with the present invention.

In the drawing 1 is a support base fabric, 2' is an acrylate foam layer, 2 is the acrylate layer after compression and setting, i.e. condensation, 3 is solid particles of filler in the foam, and 4 is solid particles of filler applied on top of the still-wet foam 2.

Figure 5:
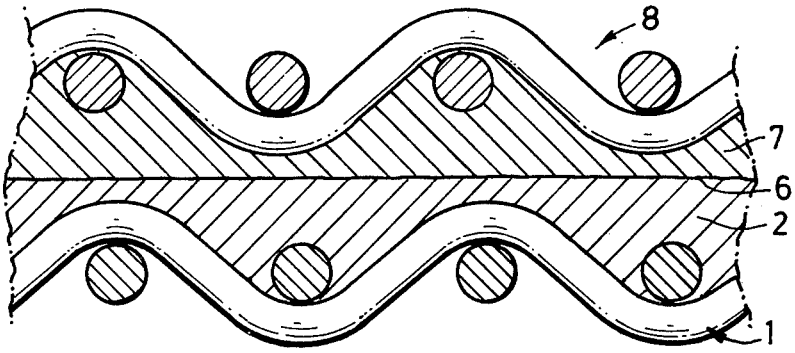

In FIG. 5, 6 is a layer of bonding agent, 7 is an acrylate dispersion and 8 is another textile fabric.

The invention will be further described in the following illustrative examples:

EXAMPLE 1

A cotton twill 1 (FIG. 1) weighing 140 g/m$^2$ is coated with an acrylate foam 2 weighing 300 g/l and manufactured by Röhm GmbH (Test Code 65/33/15). The dried coating weighs 35 g/m$^2$. The dry foam is compressed and recondensed (FIG. 2). The water column in a DIN 35 886 test is more than 100 mm high and water-vapor permeability as demonstrated by a DIN 53 122 test greater than 1000 g/m$^2$/24 hours.

EXAMPLE 2

Figure 3:
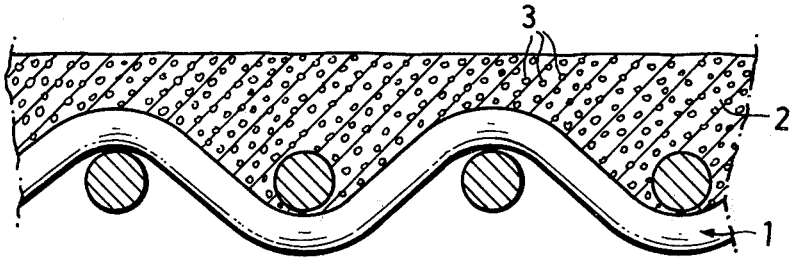
Figure 4:
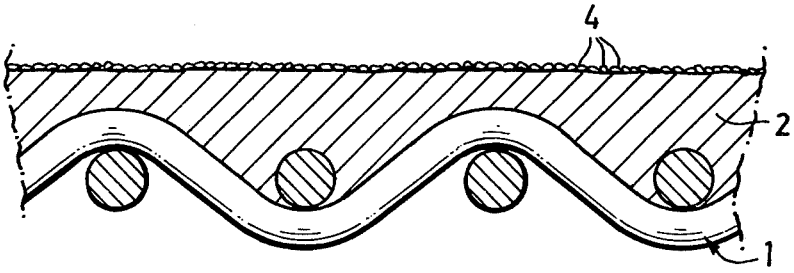

The process in Example 1 is followed except that the dried coating weighs 300 g/m$^2$ and contains 50% by weight of finely ground lead sulfate 3 (FIG. 3). This fabric is especially effective for protection against radiation.

EXAMPLE 3

The process in Example 1 is followed except that finely ground activated carbon 4 (FIG. 4) is scattered over and forced into wet acrylate foam 2, which is then dried and condensed. This waterproof and moisture-conducting fabric is effective for protection against chemical-warfare agents.

EXAMPLE 4

Figure 2:
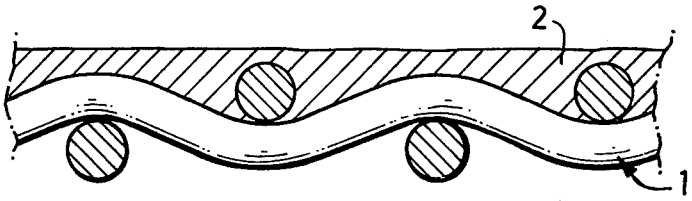

A coated textile 1, 2 (FIG. 5) is produced by the process specified in FIG. 1. An acrylate dispersion 7 with a dry weight of 10 g/m$^2$ is subsequently applied to its coated side 6. Another textile 8 is then laminated on. The fabric is condensed out and hot calendered. This double fabric allows 1000 g/m$^2$/24 hours of vapor to permeate and is especially effective when hydrophobed for protection against rain. It is a good sportswear fabric.

EXAMPLE 5

A cotton twill is coated as in Example 1 except that a dispersion of self-crosslinking polyvinyl alcohol extended with 40% of a dispersion of soft polyurethane is employed. Although the vapor permeability of this fabric is slightly lower than that of the fabric in Example 1, it is much higher than that of any known product.

It will be understood that the specification and examples are illustrative but not limitative of the present invention and that other embodiments within the spirit and scope of the invention will suggest themselves to those skilled in the art.

We claim:

1. A waterproof and moisture-conducting fabric comprising a textile base permeable to water vapor and sealed with a closed airtight and liquid-tight coating layer of a hydrophilic polymer having enough hydrophilic hydroxyl, ether, amine and/or carboxyl groups for absorbing water at points of high partial pressure, effecting migration of said water within the layer in the form of water molecules to points of low partial pressure, and releasing it in the form of water vapor again at the surface of the fabric, the coating being capable of storing 200 to 400% of its weight in moisture and allowing passage of at least 500 $g/m^2$ of water vapor per day.

2. A fabric according to claim 1, wherein the sealing coating is a coating of foam.

3. A fabric according to claim 2, wherein the foam coating is compressed.

4. A fabric according to claim 1, wherein the base is coated on both sides.

5. A fabric according to claim 1, including a second layer of vapor-permeable textile laminated onto the coating with the hydrophilic polymer.

6. A fabric according to claim 1, including protective solid particles within the coating.

7. A fabric according to claim 1, including protective solid particles on top of and adhered to the coating.

8. A fabric according to claim 1, wherein the hydrophilic polymer is a hydrophilic acrylic resin.

9. A fabric according to claim 1, wherein the hydrophilic polymer is a hydrophilic acrylic resin modified with polyvinyl chloride.

10. A fabric according to claim 1, wherein the hydrophilic polymer is a hydrophilic acrylic resin modified with polyurethane.

11. A fabric according to claim 1, wherein the coating weighs 50 to 500 $g/m^2$.

12. A protective article of clothing made from a fabric according to claim 1.

13. A rescue-at-sea garment for aviators made from a fabric according to claim 1.

14. A sleeping bag made from a fabric according to claim 1.

* * * * *